US005778989A

United States Patent [19]

Neumaier

[11] Patent Number: 5,778,989

[45] Date of Patent: Jul. 14, 1998

[54] SCREW DRIVING TOOL

[75] Inventor: Anton Neumaier, Fürstenfeldbruck, Germany

[73] Assignee: Hilti Aktiengesellschaft, Schaan, Liechtenstein

[21] Appl. No.: 687,873

[22] Filed: Jul. 26, 1996

[30] Foreign Application Priority Data

Jul. 26, 1995 [DE] Germany ..... 195 27 192.0

[51] Int. Cl.[6] ..... B25B 23/157

[52] U.S. Cl. ..... 173/178; 173/217; 192/56.1; 192/56.57

[58] Field of Search ..... 173/176, 178, 173/48, 117, 217, 93.5, 93; 192/56.1, 56.62, 56.57

[56] References Cited

U.S. PATENT DOCUMENTS 4,951,756 8/1990 Everett et al. ..... 173/178
5,343,961 9/1994 Ichikawa ..... 173/178
5,505,676 4/1996 Bookshar ..... 173/178
5,588,496 12/1996 Elger ..... 173/178
5,673,758 10/1997 Sasaki et al. ..... 173/178

*Primary Examiner*—Scott A. Smith
*Attorney, Agent, or Firm*—Anderson, Kill & Olick, P.C.

[57] ABSTRACT

A manually operable tool for driving screws has a drive pinion (3) axially fixed with a housing (1). A spindle (5) in the housing (1) is axially displaceable relative to the drive pinion against the force of a first spring (4). A clutch element (6) is located in a passageway in a collar (20) on the drive pinion (3) and is radially displaceable by a actuating member (8) for engaging the spindle (5) to the drive pinion. In the engaged position the clutch element (6) sits against a stop surface (9) in the spindle (5). The actuation member (8) is axially displaceable by stops (10, 11) located on the spindle (5) and can be axially fixed to the drive pinion by a retaining element (14) and a snap-element (15).

9 Claims, 4 Drawing Sheets

SCREW DRIVING TOOL

BACKGROUND OF THE INVENTION

The present invention is directed to a manually operable tool, such as a screw driving tool having a housing, a motor located in the housing, a motor driven drive pinion fixed axially in the housing and a spindle supported in the housing and axially displaceable relative to the drive pinion against the force of a spring. A clutch element is located between the drive pinion and the spindle.

Electrically powered screw driving tools with a disengageable clutch located between a spindle and a drive pinion are used for installing surface flush or counter sunk screws. The disengageable clutch enables an automatic, noise and wear free disengagement of the spindle from the drive pinion after the desired screw driving depth has been reached.

A screw driving tool with a clutch is disclosed in EU-PS 0 195 853 and includes a motor driven first clutch part, a axially displaceable second clutch part rotationally supported in the housing of the tool and a third clutch part axially displaceable against the force of a spring as well as being provided with a limited degree of rotation in the circumferential direction. The first clutch part is formed by a drive pinion with teeth projecting in the driving direction. The second clutch part is formed by a spindle with teeth projecting counter to the driving direction, and the third clutch part is formed by a clutch element provided on both sides with teeth. If the screw driving tool is pressed against a receiving material, that is, the material into which the screw is to be driven, the spindle is axially displaced against the force of the spring with the interposition of the clutch element, whereby all of the teeth interengage in a positive locking manner. If torque is transmitted from the drive pinion to the spindle, the clutch element is rotated and displaced axially relative to the spindle. This position of the clutch element relative to the spindle is maintained until the spindle is displaced in the driving direction after completion of the screw driving operation, until the positive locked connection between the teeth of the drive pinion and the clutch element has been terminated.

The known clutch can be fabricated only at great expense because the large teeth as well as the high weight of the parts have a negative effect on the overall weight of the screw driving tool, so that the tool operator quickly experiences tiredness when working with such a tool. In addition, the known tool is prone to great wear.

SUMMARY OF THE INVENTION

Therefore, the primary object of the present invention is to provide a clutch for a manually operated tool which can be manufactured economically and is distinguished by having a low weight and low wear.

In accordance with the present invention, the clutch element is radially displaceable in a passageway in the drive pinion extending transversely of the driving direction. The displacement of the clutch element is effected by an actuation member and in its engaged position the clutch element cooperates with at least a stop face on the spindle. The spindle has stops for axial displacement of the actuation member.

The clutch of the present invention can be fabricated economically, since all individual parts are of a simple construction instruction and have a low weight, thereby favorably affecting the overall tool weight. The stops on the spindle enable a displacement of the actuating member in the driving direction.

Preferably, the clutch element is a ball. The use of a ball affords economical manufacture of the manually operable tool, since the ball is a commercially available item, which can be bought from an outside vendor. In its radial displacement, the ball is guided in a passageway in the drive piston and the stop face cooperating with the ball is formed directly in the spindle. Another advantage is the small size of the clutch element and its low weight, which favorably affects the overall weight of the tool.

One of the stops associated with the spindle is preferably a spring having a spring force corresponding at the most to the spring force of the spring acting on the drive piston. This permits a simple assembly method, since the actuation sleeve is disposed axially upstream of the clutch element in the driving direction, so that upon overcoming the spring force of the spring, the coupling element can be shifted inwardly and upon release of the force and can be automatically displaced outwardly again.

Affixing the actuation element in the axial direction with respect to the drive pinion is effected by a stop facing opposite to the driving direction, the stop is formed by a detent element.

To obtain an axial fixing of the actuation member relative to the drive pinion, a retaining device cooperating with the spindle is preferably provided for retaining the detent element in its disengaged position. Preferably, the actuation member is automatically axially fixed at the drive pinion by having the spring act upon the retention element. For this purpose, the spindle abuts against the spring and pretensions it when the spindle is axially displaced.

The actuation member is affixed in the axial direction in a simple manner to the drive pinion by a detent member formed by a radially displaceable ball cooperating with a shoulder on the actuation sleeve.

Advantageously, the retaining element cooperates with an unlatching member disposed on a spindle. Displacement of the retaining element and unlatching of the detent element is achieved if the spindle moves in the driving direction relative to the housing or relative to the depth stop at the front end of the housing.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
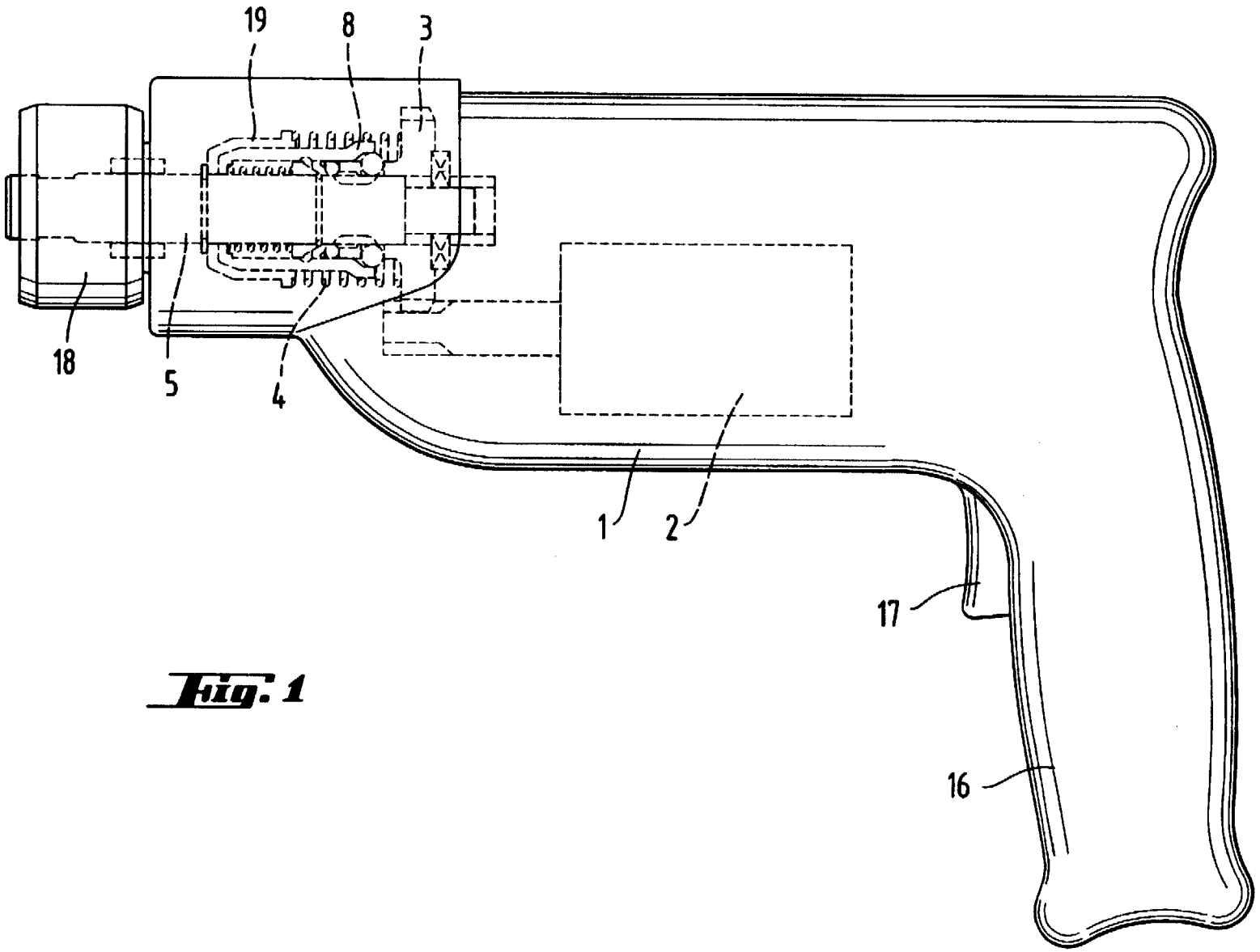
FIG. 1 is a side elevational view of a manually operable tool embodying the present invention.

In FIG. 1 a manually operable screw driving tool is illustrated with a front or leading end at the left and a trailing end at the right. Accordingly, the driving direction or axial direction is in the right end to left end direction. The housing 1 shown in FIG. 1 has a handle 16 at the trailing end with a trigger-like on-off switch 17 for controlling the operation of an electric motor 2 located within the housing. An adjustable depth stop 18 is located at the leading end, and a spindle 5 extending in the axial direction acts against the force of a first spring 4.

Figure 2:
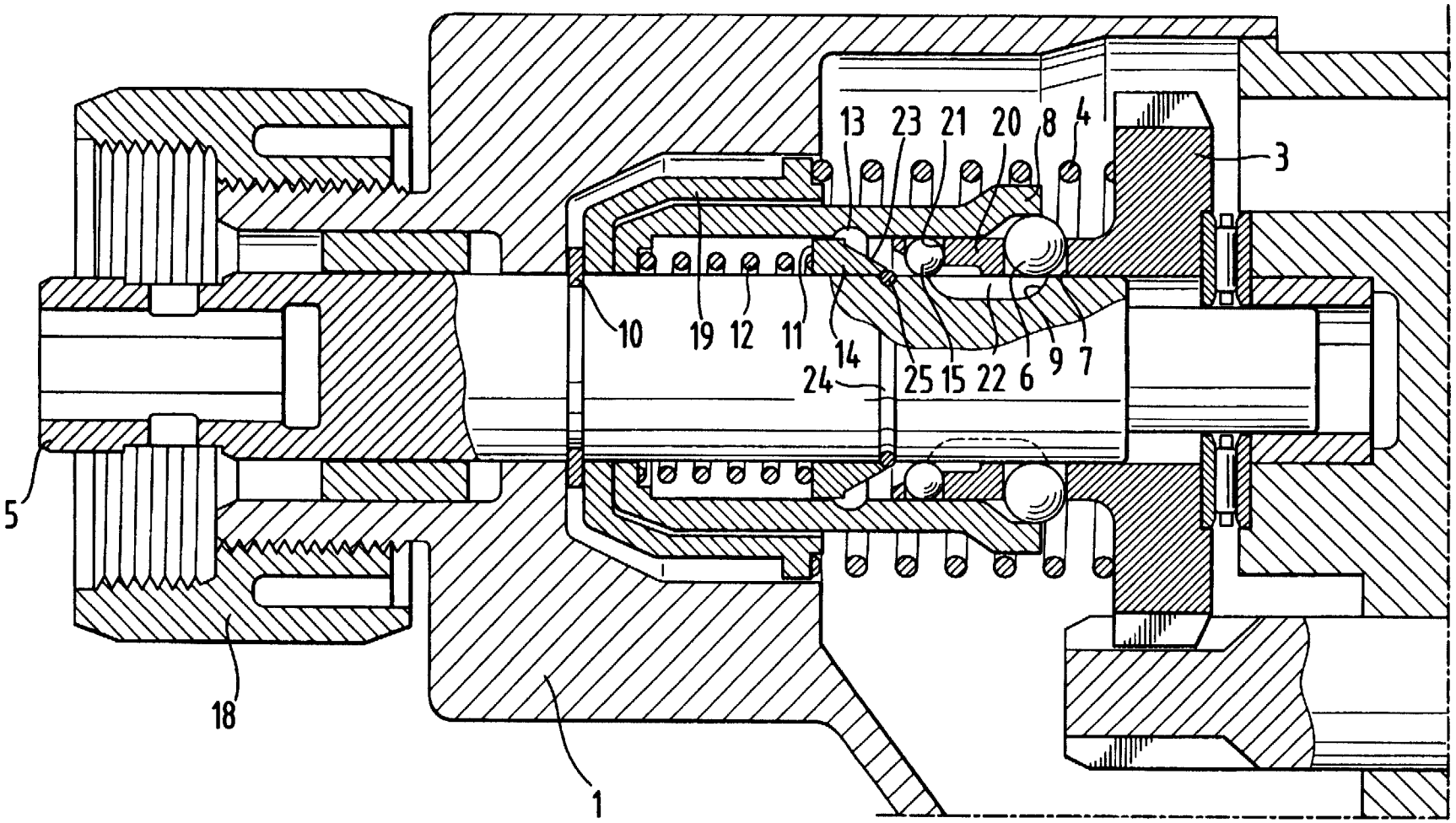
FIG. 2 is a front end portion of the manually operated tool shown in FIG. 1 in an enlarged sectional view with the clutch fully disengaged.
Figure 3:
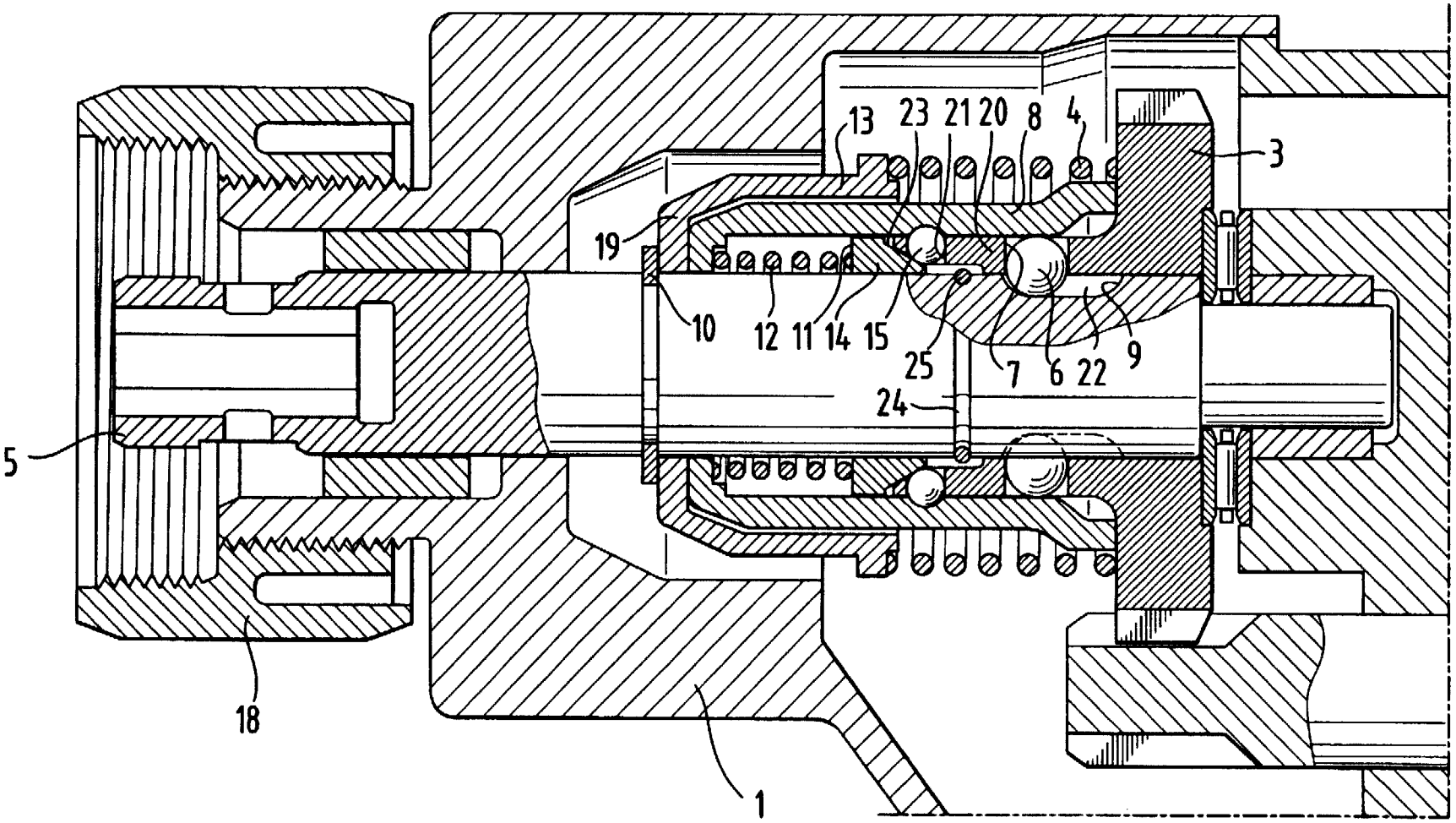
FIG. 3 is a view similar to that shown in FIG. 2, however, with the clutch in the fully engaged position.
Figure 4:
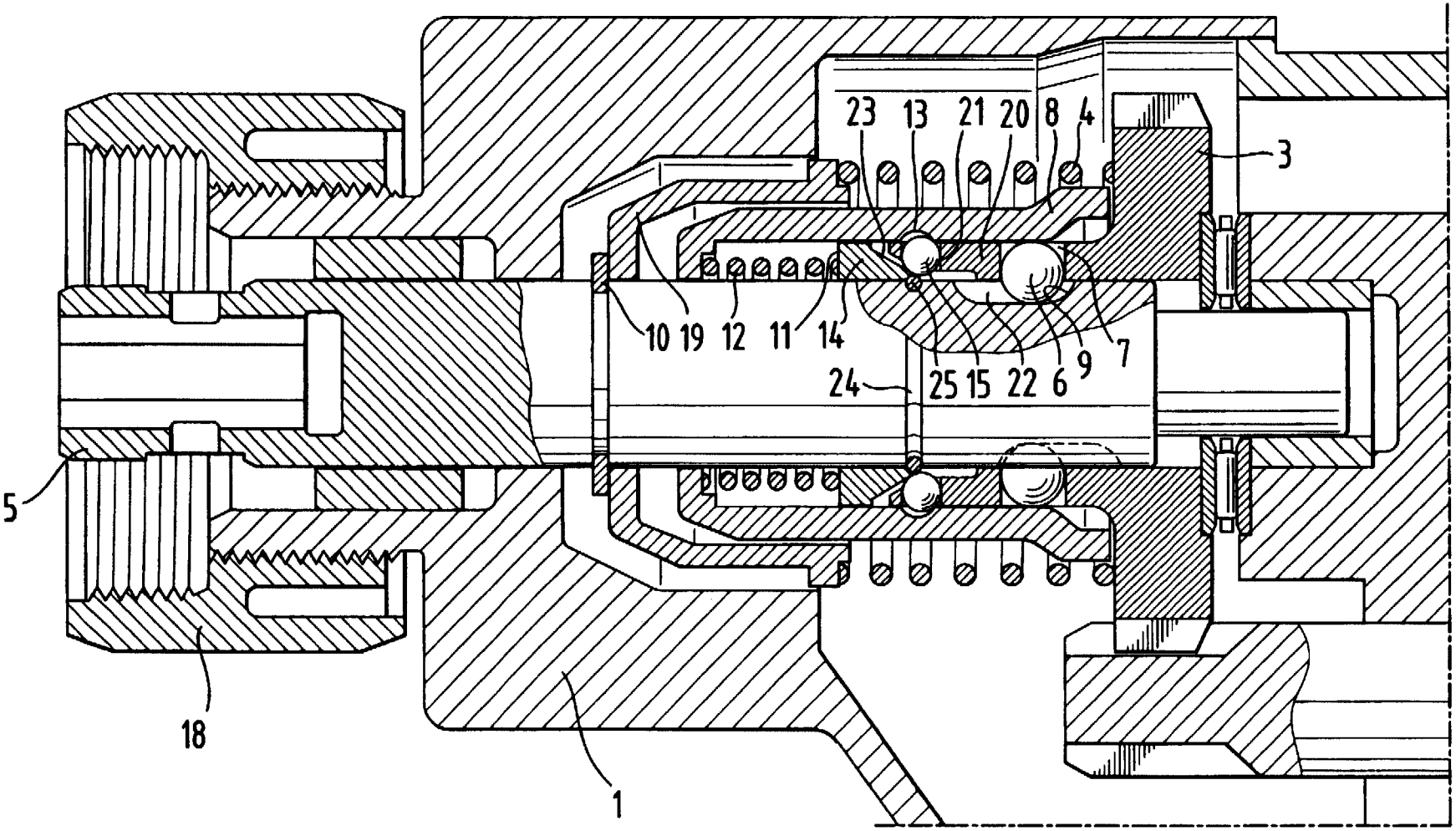
FIG. 4 is a view similar to FIGS. 2 and 3 of the manually operable clutch shown shortly before the disengagement of the clutch.

As shown in FIGS. 2–4 the housing 1 contains a motor 2 shown in phantom in FIG. 1, a drive pinion 3 driven by the motor 2, a ball shaped clutch element 6, an axially extending actuation member 8, a detent element 15 in the form a ball, a retaining element 14 with a stop surface 11 facing in the driving direction, a second spring 12 extending between the retaining element 14 and the actuation member 8, an axially extending spring collar 19 encircling the axially extending actuation member 8, with a first spring 4 extending in the axial direction from the trailing end of the spring collar 19 to the drive pinion 3, and the axially displaceable spindle 5 having a stop 10 at the front end of the spring collar 19 with a surface facing opposite to the setting direction. The stop 10 is connected to the spindle.

The drive pinion 3 is mounted on the spindle 5 and is axially fixed and freely rotatable. The pinion 3 has an axially extending collar 20 as extending from the pinion in the driving direction and laterally enclosing the spindle 5. The collar has a first passageway 7 extending through it transversely of the driving or axial direction. Forwardly of the first passageway 7 is a second passageway 21 extending transversely of the driving direction. The ball shaped clutch element 6 is located in the first passageway 7 closer to the toothed region of the drive pinion 3 and is radially displaceable by an axially extending sleeve-like actuation member 8. The clutch element 6 can be placed in connection with a stop surface 9 in the form of an axially extending groove 22 on the surface of the spindle 5. As a result, a connection between the spindle 5 and the drive pinion 3 is established so that they rotate together.

The axially extending actuation member 8 laterally surrounds the collar 20 on the drive pinion 3 and is displaceable relative to the collar in a telescopic manner. A circumferentially extending recess 13 is formed in the inner surface of the actuation member and the recess is arranged to receive a snap-in element in the form of a detent ball 15. The ball-shaped snap-in element 15 is located in the second passageway 21 of the collar 20 on the drive pinion 3 and can be moved radially by a retaining element 14 extending circumferentially around the surface of the spindle 5.

The wall thickness of the collar 20 at its leading end tapers in a conically shaped manner outwardly towards the inner surface of the actuation member 8 in the region of the second passageway 21. The retaining element 14, encircling the spindle 5 is axially displaceable relative to the spindle and is ring-shaped and has an obliquely extending surface sloping outwardly in and cooperating with the cone-shaped surface of the collar so that the snap-in detent ball 15 is radially displaced relative to the collar if the retaining element 14 is moved axially.

The spring collar 19 partially encloses the actuation member 8 at its leading end and can be moved telescopically relative to it. The first spring 4, located between the end of the spring collar 19 and the drive pinion 3 encircles the actuation member 8 formed as a sleeve having a leading end which is partially closed, that is, it extends inwardly towards the spindle 3. Between the stop surface 9 on the spindle 5, formed as an axially extending groove 22, and the ring-shaped stop 10 having a trailing surface facing counter to the driving direction there is a circumferentially extending depression or recess in the outer surface of the spindle which serves for receiving an unlatching element 25 in the form of an O-ring.

The following is a description of the procedure for driving a screw by means of the screw driving tool into a receiving material, not shown.

The leading end face of the spindle 5 can be connected to a bit for driving a screw. By pressing the screw driving tool against a receiving material, the spindle 5 along with the spring collar 19 and the actuation member 8 are moved axially the first spring 4. The screw, the receiving material and the bit are not illustrated. The ball shaped clutch element 6 is moved radially inwardly by the actuation member 8 so that it moves into the axially extending groove 22 on the spindle into contact with the stop surface 9. This movement connects the spindle 5 with the drive pinion 3 so that they are rotated as a unit.

During the axial displacement of the spindle 5 opposite to the driving direction, the ring-shaped retaining element 14 is also displaced axially until it bears against the snap-in ball 15 which is held in the second passageway 21 in the collar 20. A radial force component is applied to the ball 15 by the oblique surface 23 of the retaining element 14. As soon as the axial movement of the actuation member 8 has reached its end position the recess 13 located on the inner surface of the actuation member 8, in the form of a circumferential extending groove, is located above the detent ball 15. The second spring 12 can now move the retaining element 14 further in the direction opposite to the driving direction and the ball 15 is pressed radially outwardly into the recess 13. As a result, the actuation member 8 is latched in a self-locking manner to the drive pinion 3.

Shortly before the screw reaches its desired depth, the depth stop 18 contacts the receiving material. The spindle 5 continues to rotate and moves in the driving direction under the force of the spring 4. At the same time the spring cup 19 is also displaced in the driving direction.

As soon as the spindle 5 reaches the position where the screw has attained its desired depth, the unlatching element 25, in the form of an O-ring, is moved in the driving direction against the retaining element 14 moving it in the driving direction with the release of the snap-in ball 15. The unlatching element 25 is seated in the circumferentially extending recess 24 of the spindle 5. Subsequently, the second spring 12 moves the actuation member in the driving direction. This movement displaces the ball 6, connecting the drive pinion 3 to the spindle 5 in a rotationally locked manner, whereby such locked engagement is disconnected.

While specific embodiments of the invention have been shown and described in detail to illustrate the inventive principles, it will be understood that the invention may be embodied otherwise without departing from such principles.

I claim:

1. A manually operable tool comprising a housing (1) having a leading end, a trailing end, and an axially extending driving direction from the trailing end to the leading end, a motor (2) located in said housing, a drive pinion (3) fixed in the axial direction within said housing an axially extending spindle (5) mounting said drive pinion and being axially displaceable relative to the drive pinion (3) against a first spring (4) having a spring force, a clutch element (6) for engaging said spindle (5) to said drive pinion (3), said drive pinion having an axially extending collar (20) extending towards the leading end of said housing and encircling said spindle (5), said collar (20) having a first passageway (7) extending transversely of the axial direction and said clutch element (6) being mounted in said first passageway and being radially displaceable by an axially extending actuation member (8) at least partially encircling said collar (20), said clutch element (6) having a radially outer disengaged position and a radially inner engaged position coupling said drive pinion to said spindle, in the radially inner position, said clutch element (6) engages a stop surface (9) formed in said spindle (5), and stops (10, 11) cooperating with said spindle (5) for axially displacing said actuation member (8).

2. A manually operable tool, as set forth in claim 1, wherein said clutch element (6) is a ball.

3. A manually operable tool, as set forth in claim 1 or 2, wherein said stops (10, 11) on said spindle being spaced axially apart.

4. A manually operable tool, as set forth in claim 1 or 2, wherein a first one of said stops (11) facing in the driving direction and contacting a second spring (12) having a spring force corresponding at the most to the spring force of the first spring (4).

5. A manually operable tool, as set forth in claim 3, wherein a second said stop (10) having a surface facing opposite to the driving direction and being formed as an annular member seated in and extending around and outward from an outside surface of said spindle (5).

6. A manually operable tool, as set forth in claim 5, wherein a retaining element (14) encircles said spindle (5) and cooperates with said spindle for retaining a snap-in element in position.

7. A manually operable tool, as set forth in claim 6, wherein a second spring (12) encircles said spindle in the axial direction and bears at a trailing end against said retaining element (14) and at a leading end against said actuation member (8).

8. A manually operable tool, as set forth in claim 6, wherein said snap-in element comprises a radially displaceable snap-in ball (15) engageable in a circumferentially recess (13) in an inner surface of said actuation member (8).

9. A manually operable tool, as set forth in claim 8, wherein said retaining element (14) arranged to cooperate with an unlatching element (25) seated in an outside surface of said spindle (5).

* * * * *